US008098124B2

(12) United States Patent
Perrillat-Amede et al.

(10) Patent No.: US 8,098,124 B2
(45) Date of Patent: Jan. 17, 2012

(54) HIGH-VOLTAGE TRANSFORMER AND POWER SUPPLY FOR AN X-RAY TUBE INCLUDING SUCH A TRANSFORMER

(75) Inventors: Denis Perrillat-Amede, Buc (FR); Philippe Ernest, Buc (FR); Georges-William Baptiste, Buc (FR); Patrick Feat, Buc (FR)

(73) Assignee: General Electric Company, Schenectady, NY (US)

( * ) Notice: Subject to any disclaimer, the term of this patent is extended or adjusted under 35 U.S.C. 154(b) by 121 days.

(21) Appl. No.: 12/731,176

(22) Filed: Mar. 25, 2010

(65) Prior Publication Data

US 2010/0245014 A1 Sep. 30, 2010

(30) Foreign Application Priority Data

Mar. 25, 2009 (FR) ..... 09 51945

(51) Int. Cl.
*H01F 27/28* (2006.01)

(52) U.S. Cl. ..... 336/182

(58) Field of Classification Search ..... 336/170, 336/173–175, 180–184; 378/101–106; 363/59–61
See application file for complete search history.

(56) References Cited

U.S. PATENT DOCUMENTS 3,263,151 A * 7/1966 Boeker ..... 363/135
3,281,643 A * 10/1966 Boeker ..... 363/135
3,502,877 A * 3/1970 Splain ..... 378/96
5,023,768 A 6/1991 Collier
5,335,161 A * 8/1994 Pellegrino et al. ..... 363/61
5,757,633 A * 5/1998 Bowles ..... 363/71
5,835,367 A 11/1998 Pan et al.
6,563,717 B2 * 5/2003 Lunding et al. ..... 363/15

FOREIGN PATENT DOCUMENTS

DE 4107199 A1 9/1992
EP 0381580 A1 8/1990
EP 0429315 A2 5/1991
FR 2239040 A1 2/1975
WO 0152415 A1 7/2001
WO 03092148 A1 11/2003

* cited by examiner

*Primary Examiner* — Tuyen Nguyen
(74) *Attorney, Agent, or Firm* — Global Patent Operation; Jonathan E. Thomas

(57) ABSTRACT

A high-voltage transformer has a plurality of elementary transformers. Each elementary transformer comprises an elementary primary circuit configured to be powered by an elementary primary voltage, an elementary secondary circuit comprising at least one secondary winding and at least one capacitor that is connected to the terminals of a secondary winding, and an elementary magnetic circuit configured to couple the elementary primary circuit and the elementary secondary circuit. The output voltage of the transformer is equal to the sum of the elementary balanced secondary voltages, and the elementary primary circuits are connected to one another so as to form a common circuit with the elementary transformers. The common circuit is configured to be supplied by a primary voltage, which is equal to the sum of the elementary primary voltages.

7 Claims, 7 Drawing Sheets

HIGH-VOLTAGE TRANSFORMER AND POWER SUPPLY FOR AN X-RAY TUBE INCLUDING SUCH A TRANSFORMER

CROSS-REFERENCE TO RELATED APPLICATIONS

This application claims priority under 35 U.S.C. §§119(a)-(d) or (f) to prior-filed, co-pending French patent application number 0951945, filed on Mar. 25, 2009, which is hereby incorporated by reference in its entirety.

STATEMENT REGARDING FEDERALLY SPONSORED RESEARCH OR DEVELOPMENT

Not Applicable

NAMES OF PARTIES TO A JOINT RESEARCH AGREEMENT

Not Applicable

REFERENCE TO A SEQUENCE LISTING, A TABLE, OR COMPUTER PROGRAM LISTING APPENDIX SUBMITTED ON COMPACT DISC

Not Applicable

BACKGROUND OF THE INVENTION

1. Field of the Invention

This invention relates to high-voltage transformers and more specifically those implemented in high-voltage power supplies, in particular those implemented in medical imaging devices and more specifically power supplies for X-ray tubes of such devices.

2. Description of Related Art

There are numerous constraints on power supplies for X-ray tubes. These power supplies, when used, for example, in tomography, are in particular subjected to strong accelerations of several dozen G (the X-ray source rapidly rotating about the patient or the object to be imaged).

In addition, these power supplies must be capable of switching very quickly from a first high voltage to a second high voltage so as to modify the nature of the X-rays, in order in particular to obtain a contrasted image of the patient or object.

The components used in X-ray tube power supplies must be reliable and have good performances.

In such a power supply, a limiting component is in particular the high-voltage transformer.

Indeed, high-voltage transformers are complex in particular due to the high-voltage isolation between primary and secondary windings.

In addition, the high-voltage transformer must satisfy mass and size constraints (it must be capable of being integrated in a medical imaging device) and be inexpensive.

BRIEF SUMMARY OF THE INVENTION

The invention enables a lightweight and compact high-voltage transformer to be obtained, implementing small magnetic circuits and integrating rectifier circuits consisting of generic components, therefore inexpensive and simple to produce by comparison with the known transformers.

In addition, the transformer of the invention has superior performance over the known transformers.

The transformer of the invention is based on the use of elementary transformers arranged on a common primary circuit and on the use of capacitors for balancing the voltages generated by the elementary secondary circuits of each elementary transformer.

The invention therefore relates to a high-voltage transformer including a plurality of elementary transformers.

Each elementary transformer includes: an elementary primary circuit intended to be supplied by an elementary primary voltage and an elementary secondary circuit, in which each elementary secondary circuit includes at least one second winding; at least one capacitor, each connected to the terminals of a secondary winding so as to balance the secondary voltages with one another; in which the elementary secondary circuit is intended to generate a balanced elementary secondary voltage.

Each elementary transformer also includes an elementary magnetic circuit intended to couple the elementary primary circuit and the elementary secondary circuit.

The output voltage of the transformer of the invention is equal to the sum of the balanced elementary secondary voltages, and the elementary primary circuits are connected to one another so as to form a common circuit with the elementary transformers, which common circuit is intended to be supplied by a primary voltage, in which the primary voltage is equal to the sum of the elementary primary voltages.

The transformer of the invention can also optionally have one of the following features:

- each elementary transformer also includes at least one rectifier circuit, each connected to the terminals of a capacitor, in which the voltage at the output of the transformer is equal to the sum of the balanced and rectified elementary secondary voltages;
- in each elementary transformer, the secondary winding are alternately wound, one winding in one direction, the next in the other direction, so as to limit the voltage difference between two adjacent secondary windings wound around the elementary magnetic circuit;
- the magnetic circuits are made of nano crystalline iron; and
- each voltage rectifier circuit includes, at its terminals, a filtering capacitor, so as to generate a continuous voltage at the output of the transformer.

According to a second aspect, the invention relates to a power supply for an X-ray tube including a high-voltage transformer according to the first aspect of the invention.

According to a third aspect, the invention relates to a medical imaging device including a power supply for an X-ray tube according to the second aspect of the invention.

BRIEF DESCRIPTION OF THE SEVERAL VIEWS OF THE DRAWINGS

Other features and advantages of the invention will become clear from the following description, provided solely for illustrative and non-limiting purposes, which should be read in reference to the appended drawings, in which.

DETAILED DESCRIPTION OF THE INVENTION

Figure 1:
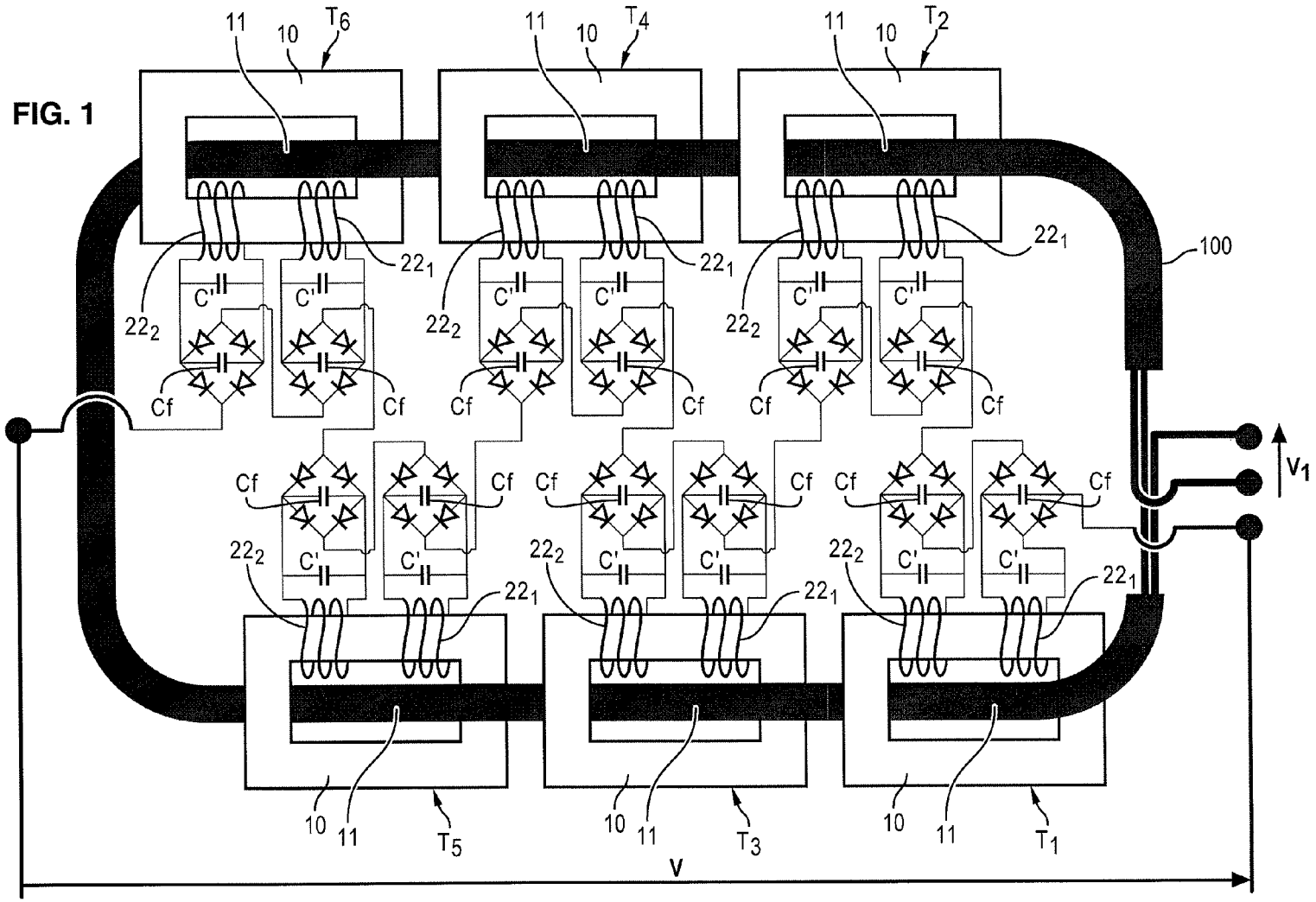
FIG. 1 shows a high-voltage transformer according to the invention.

FIG. 1 shows a high-voltage transformer including a number N≧2 of elementary transformers $T_i$.

Figure 2:
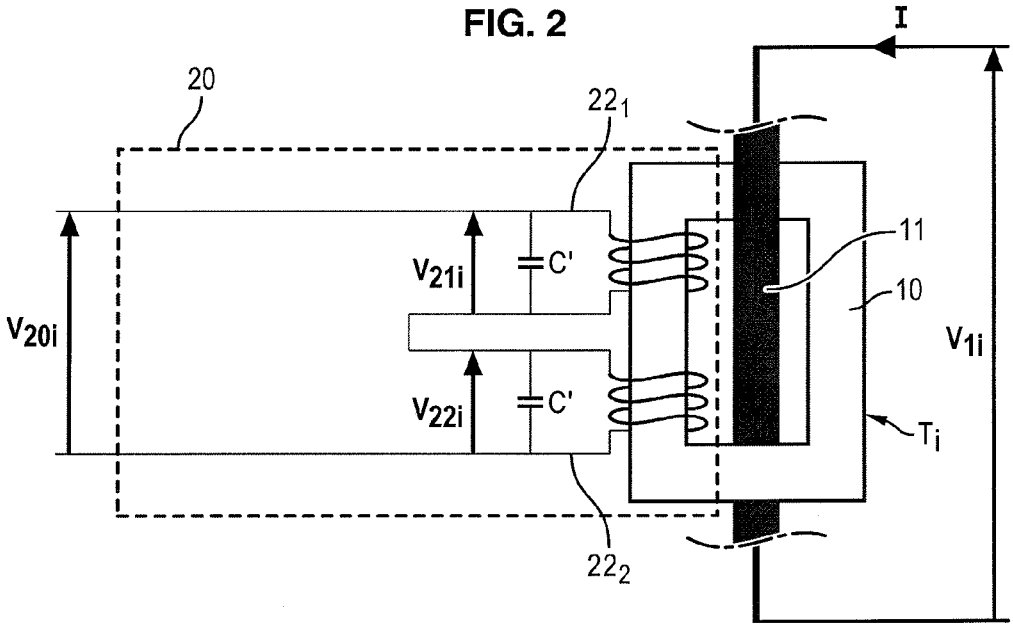
FIG. 2 shows a first embodiment of an elementary transformer of the transformer according to the invention.
Figure 3:
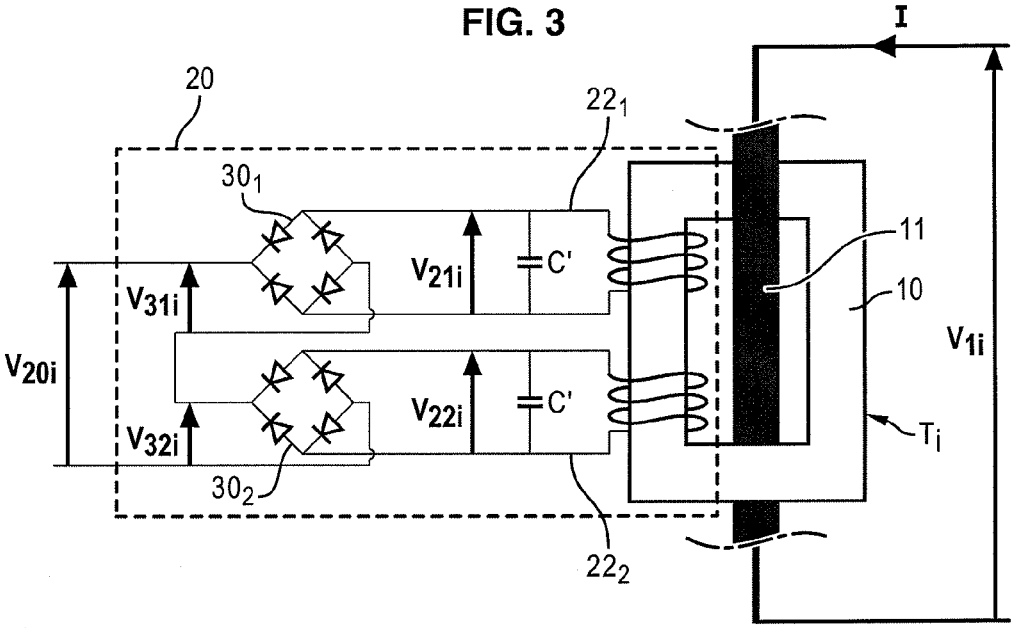
FIG. 3 shows a second embodiment of an elementary transformer of the transformer according to the invention.

FIGS. 2 and 3 show an elementary transformer $T_i$ according, respectively, to a first and a second embodiment.

Each elementary transformer $T_i$ includes an elementary magnetic circuit 10, an elementary primary circuit 11, and an elementary secondary circuit 20.

For each elementary transformer $T_i$, the elementary magnetic circuit 10 is intended to be coupled to the elementary primary circuit 11 and the elementary secondary circuit 20.

Each elementary primary circuit 11 is supplied by an elementary primary voltage $V1_i$.

The elementary primary circuits 11 are connected to one another in series so as to form a primary circuit 100 common to all of the elementary transformers $T_i$.

The common circuit 100 is supplied by a primary voltage $V_i$ and each elementary primary circuit 11 is supplied—as already mentioned—by an elementary primary voltage $V1_i$ so that the primary voltage V1 is equal to the sum of the elementary primary voltages $V1_i$ is $$V1 = \sum_{i=1}^{N} V1_i.$$

It is noted that the current I circulating in the elementary primary circuits 11 is identical from one elementary transformer $T_i$ to another.

The common primary circuit 100 preferably consists of a winding of one turn for high-power applications or of two or more turns for low-power applications.

The elementary magnetic circuits 10 of each elementary transformer $T_i$ are preferably toric and are arranged on the common circuit 100, which is preferably in the shape of a rectangular ring.

Each elementary secondary circuit 20 includes at least one secondary winding $\mathbf{22}_1$, $\mathbf{22}_2$ wound around the magnetic circuit 10.

Each elementary secondary circuit 20 is intended to generate an elementary secondary voltage $V\mathbf{20}_i$, which is balanced from one elementary transformer to another. In other words, the voltages generated by each elementary transformer are balanced with one another.

To do this, the elementary secondary circuit 20 includes at least one capacitor C' with a known set value, each connected to the terminals of a secondary winding $\mathbf{22}_1$, $\mathbf{22}_2$.

Indeed, the magnetic circuits 11 can have dispersions, and the secondary voltages from one magnetic circuit to the other may not all be identical. These dispersions are due primarily to differences in permeability and cross-section. They are significant, typically more or less 30%, and it is expensive to remove them, for example by screening.

It should be noted that a capacitor is preferred to a resistor (in order to obtain the same result) for minimizing losses. Indeed, a resistor would add a dissipative element (which would generate losses)—an inductance (with a known set value) could also ensure the balancing function but would be complex (and expensive and bulky) to use.

The voltage V at the output of the transformer is equal to the sum of the elementary balanced secondary voltages $V\mathbf{20}_i$ generated by the elementary secondary circuits 20.

Indeed, each elementary transformer $T_i$ generates the same voltage $V\mathbf{2}_i$ and it is the series arrangement of the elementary secondary circuits 20 that enables the high voltage V to be obtained at the outlet of the transformer.

It should be noted that the total capacity at the terminals of the transformer, resulting from the association in series of the capacitors at the terminals of the N elementary transformers, decreases when the number N of elementary transformers increases. When the number N of elementary transformers is high, the transformer then has a low output capacity that enables it to switch very quickly from a first high voltage to a second high voltage. This performance is further enhanced when, in addition, the number of secondary windings is high, as the capacity at the terminals of each elementary transformer is itself decreased.

According to a first embodiment, the transformer can function so as to generate an alternating voltage (see FIG. 2).

According to a second embodiment, the transformer can function so as to generate a rectified voltage (see FIG. 3).

In rectified operation, each elementary transformer $T_i$ also includes a rectifier circuit $\mathbf{30}_1$, $\mathbf{30}_2$ connected to the terminals of each winding of the elementary secondary circuit 20.

Each rectifier circuit $\mathbf{30}_1$, $\mathbf{30}_2$ is therefore mounted in parallel with the corresponding capacitor C'.

The rectifier circuits $\mathbf{30}_1$, $\mathbf{30}_2$ are also connected to one another. The elementary secondary circuits 20 are therefore connected to one another via these voltage rectifier circuits $\mathbf{30}_1$, $\mathbf{30}_2$.

Such rectifier circuits $\mathbf{30}_1$, $\mathbf{30}_2$ are, for example, known diode bridges (i.e. single rectifiers, doublers or multipliers).

In the case of rectifier circuits, the output voltage of the transformer is equal to the sum of the elementary balanced secondary voltages from one transformer to the next and rectified, generated by each elementary transformer $T_i$.

Each elementary secondary circuit can include—as already mentioned—one or more windings.

The elementary secondary circuit is therefore subdivided into a plurality of windings, enabling the alternating voltage to be reduced at the terminals of the balancing capacitors and at the terminals of the rectifiers.

This contributes to a reduction in the production costs and to an improvement in the reliability of the transformer, and enables high quantities of generic components to be implemented for numerous applications, and with proven technology (in particular 600V or 1200V capacitors and diodes).

The generic components are in particular the capacitors and the elements of the rectifier circuits.

For each elementary transformer $T_i$, these windings are distributed around the elementary magnetic circuit 10.

The limitation of the voltage enables, in the case of rectified operation, the dielectric losses in the insulating material of the magnetic core windings to be limited (these losses are proportional to the square of the alternating voltage).

If the elementary secondary circuits include a plurality of secondary windings $\mathbf{22}_1$, $\mathbf{22}_2$, the latter are wound around the corresponding elementary magnetic circuit 10, alternating, with one in one direction and the other in the other direction.

Such a method of winding the sections enables, by alternating the direction of the current in the windings, the maximum voltage between two adjacent windings to be reduced, facilitating the isolation between them.

Figure 4:
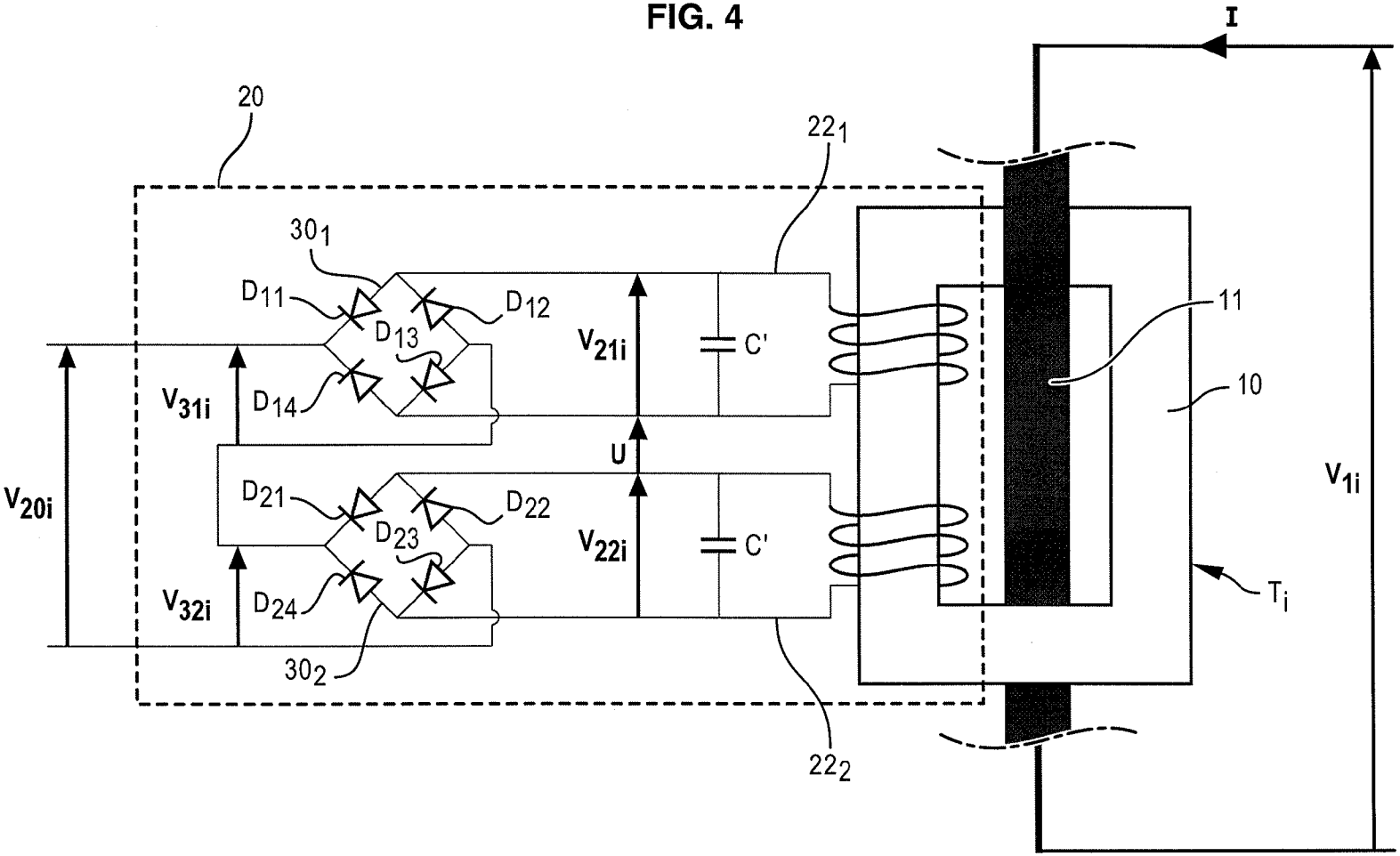
FIG. 4 shows the elementary transformer of the second embodiment with windings in the same direction.

In the case shown in FIG. 4, in which the secondary windings are all in the same direction, during the positive alternation of the voltage $V1_i$, the diodes $D_{11}$, $D_{13}$, $D_{21}$ and $D_{23}$ lead and the voltage U between the two windings $22_1$ and $22_2$ is zero; during the negative alternation of the voltage $V1_i$, the diodes $D_{12}$, $D_{14}$, $D_{22}$ and $D_{24}$ lead and the voltage U between the two windings $22_1$ and $22_2$ is equal to the sum of the voltages $V21_i$ and $V22_i$.

Figure 5:
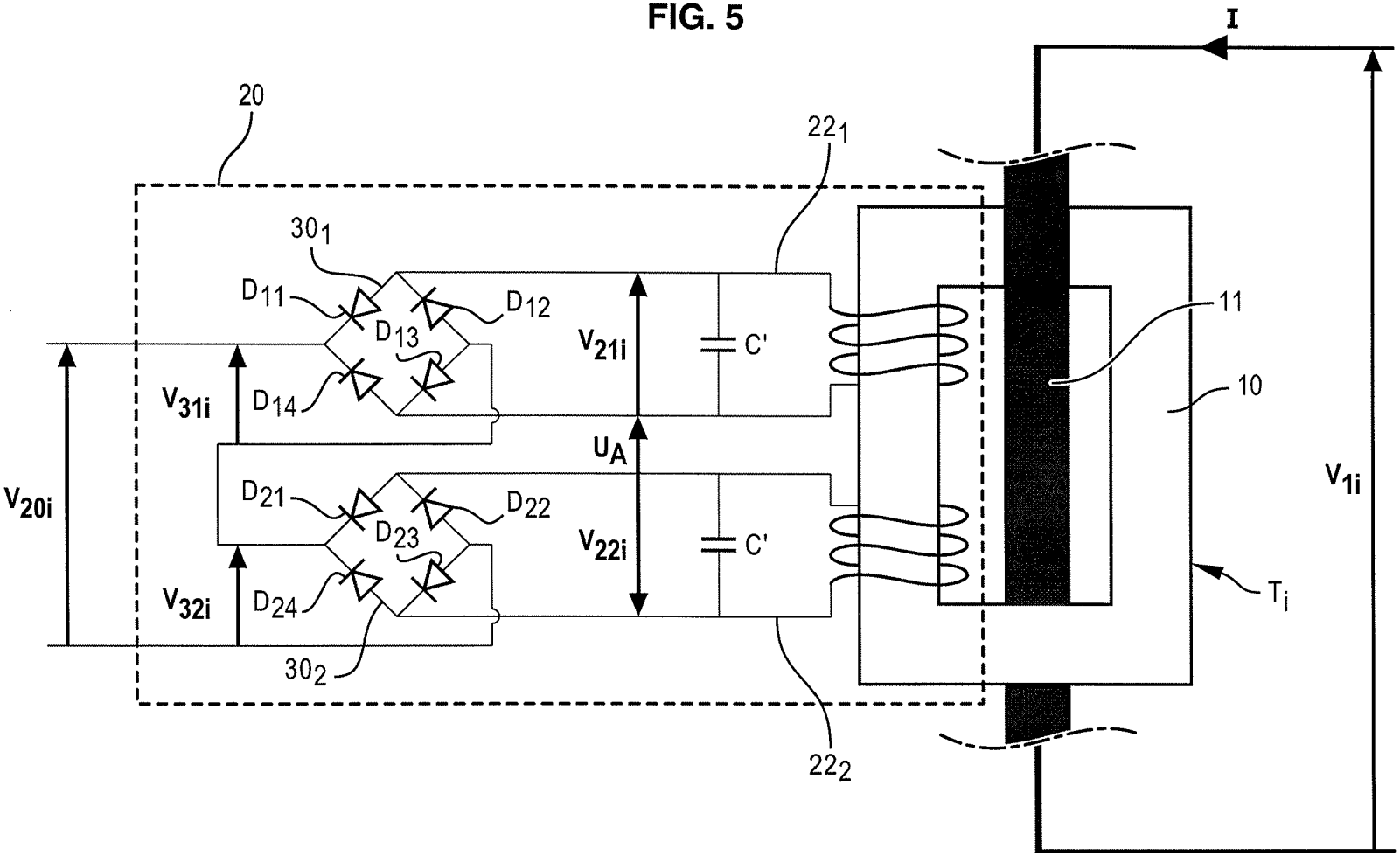
FIG. 5 shows the elementary transformer of the second embodiment with alternating windings.

In the case shown in FIG. 5, in which the secondary windings are one in one direction and the other in the other directions, during the positive alternation of the voltage $V1_i$, the diodes $D_{11}$, $D_{13}$, $D_{22}$ and $D_{24}$ lead and the voltage $U_A$ between the two windings $22_1$ and $22_2$ is equal to $V22_i$; during the negative alternation of the voltage $V1_i$, the diodes $D_{12}$, $D_{14}$, $D_{21}$ and $D_{23}$ lead and the voltage $U_A$ between the two windings $22_1$ and $22_2$ is equal to $V21_i$.

Figure 6:
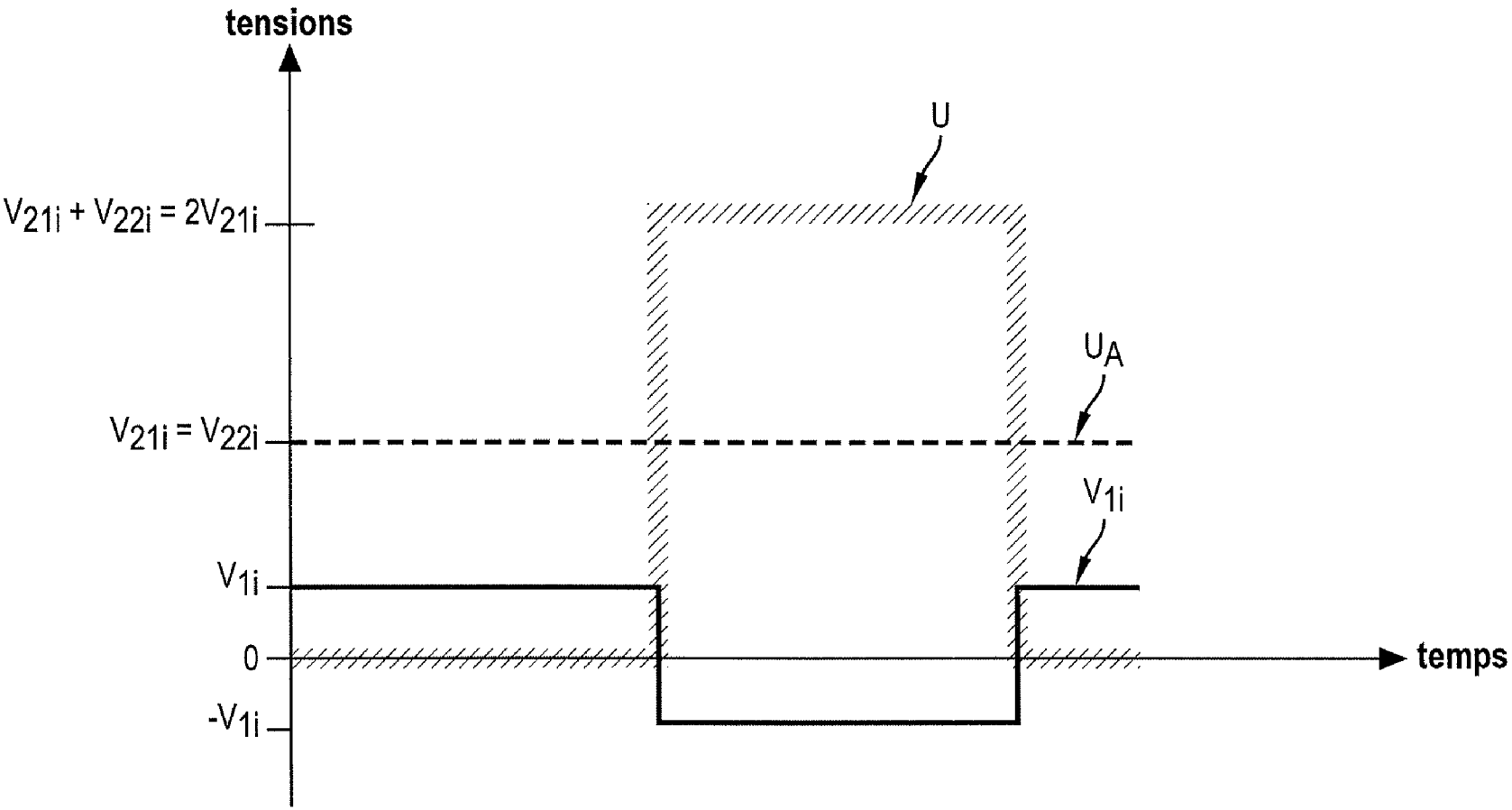
FIG. 6 shows a timing chart of the voltages between two windings of an elementary transformer.

In the most common embodiment, the windings $22_1$ and $22_2$ have the same number of turns, and the voltages $V21_i$ and $V22_i$ are therefore equal; the maximum value of the voltage $U_A$ between alternating windings is then equal to half of the maximum value of the voltage U between non-alternating windings, which means a significant gain (see FIG. 6).

This result, described above for a single rectifier circuit, is also valid for a doubler-rectifier and for a multiplier-rectifier.

It is noted that the voltage generated by each elementary transformer $T_i$ with two or more windings is identical to the voltage generated by an elementary transformer $T_i$ with one winding.

In the production of the transformer, the elementary transformers $T_i$, the corresponding capacitors and the corresponding rectifier circuits are arranged in pairs on a printed circuit.

The elementary transformers $T_i$ are positioned horizontally according to their main axis for static systems—transformer not subjected to accelerations—and tangentially for rotary systems—rotating transformer, subjected to centrifugal acceleration. This enables the cooling by convection of each elementary circuit to be significantly improved.

The printed circuits including a pair of elementary transformers are then wound on the common primary circuit. The arrangement shown in FIG. 1 is obtained.

The elementary magnetic circuits also consist of nanocrystalline iron. Such a material has good performance in terms of power density and magnetic coupling.

Due to its high permeability, this material enables the number of turns of the primary winding 100 to be limited, and manages with a low-value balancing capacity, and is therefore less expensive and more compact.

Owing to the structure of the material, it is possible to operate at high frequencies with an acceptable level of losses.

Figure 7:
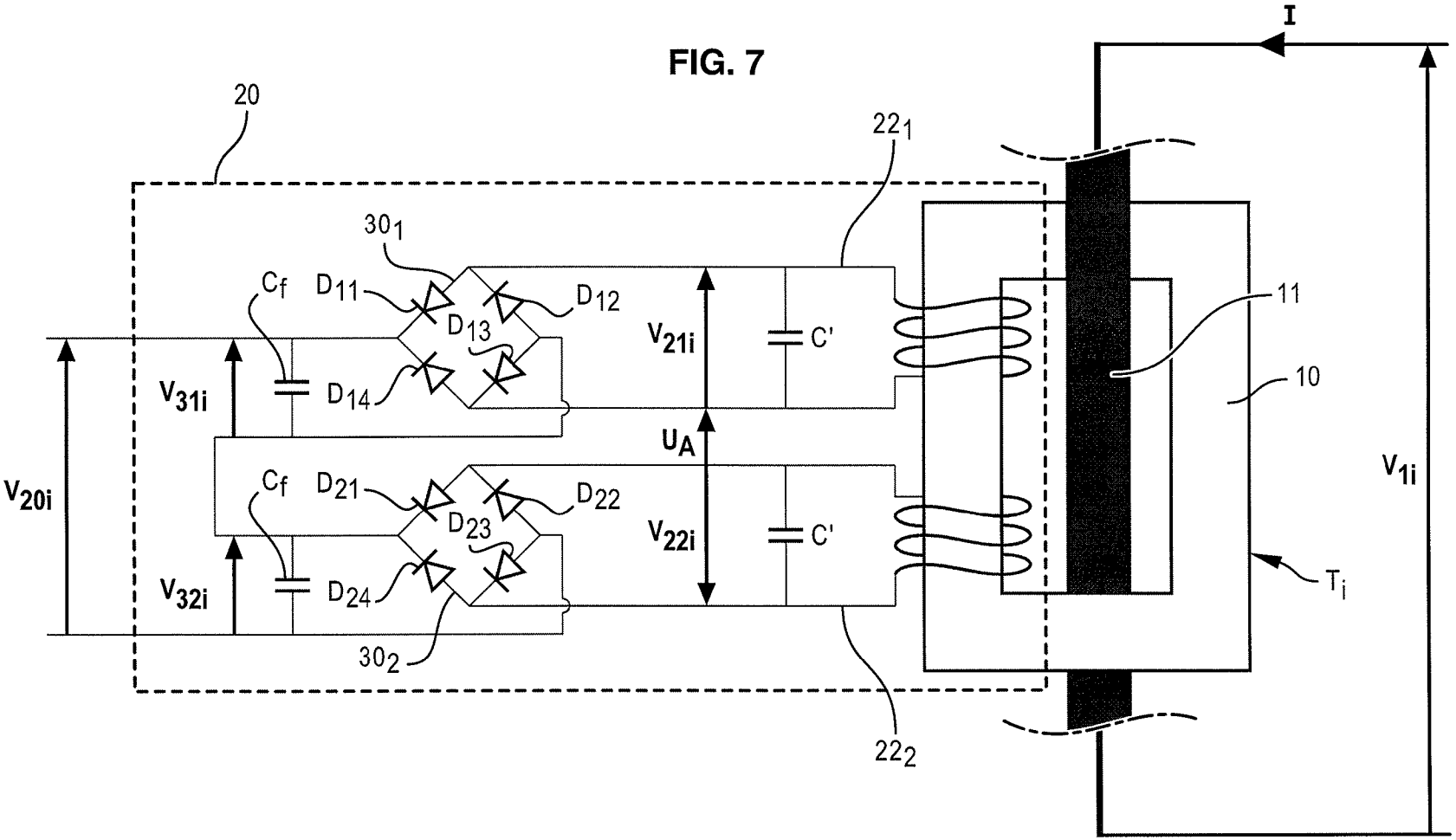
FIG. 7 shows the transformer of the second embodiment in which the output voltage is rectified and filtered.

To generate a continuous voltage V at the output of the transformer, a filtration capacitor $C_f$ is added to the terminals of each rectifier $30_1$, $30_2$ according to FIG. 7.

Figure 8:
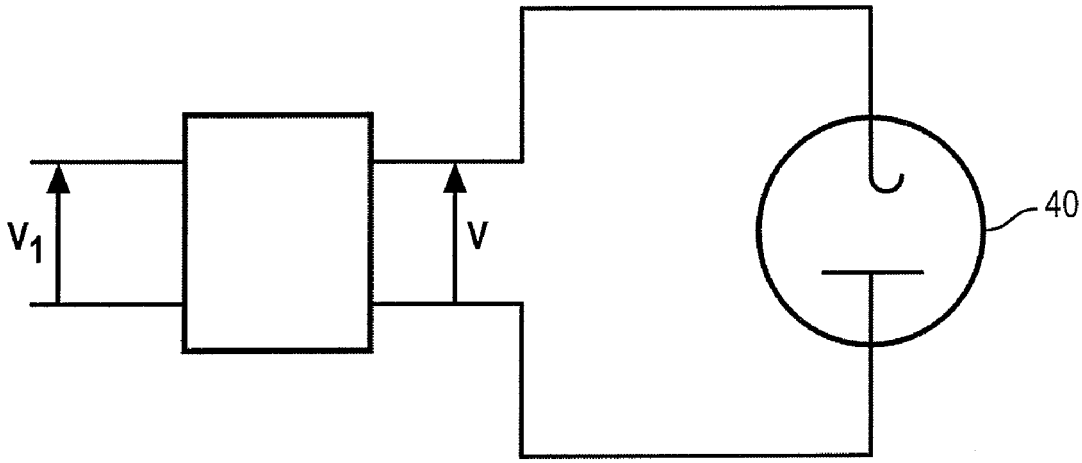
FIG. 8 shows a high-voltage power supply connected to the X-ray tube.

The transformer described above enables an X-ray tube to be supplied with power. The transformer connected to the X-ray tube 40 is shown in FIG. 8.

What is claimed is:

1. A high-voltage transformer, comprising:

a plurality of elementary transformers, in which each elementary transformer comprises:

an elementary primary circuit configured to be powered by an elementary primary voltage;

an elementary secondary circuit that comprises:

at least one secondary winding; and at least one capacitor, each connected to the terminals of a secondary winding, so as to balance the secondary voltages, with one another;

wherein the elementary secondary circuit is configured to generate an elementary balanced secondary voltage; and an elementary magnetic circuit configured to couple the elementary primary circuit and the elementary secondary circuit;

wherein the output voltage of the transformer is equal to the sum of the elementary balanced secondary voltages, and wherein the elementary primary circuits are connected to one another so as to form a common circuit with the elementary transformers, wherein said common circuit is configured to be supplied by a primary voltage, which primary voltage is equal to the sum of the elementary primary voltages.

2. The transformer of claim 1, wherein each elementary transformer also comprises at least one voltage rectifier circuit, wherein each voltage rectifier circuit is connected to the terminals of a capacitor, in which the output voltage of the transformer is equal to the sum of the balanced and rectified elementary secondary voltages.

3. The transformer of claim 2, wherein in each elementary transformer, the secondary windings are alternately wound, one winding in one direction, the next in the other direction, so as to limit the voltage difference between two adjacent secondary windings wound around the elementary magnetic circuit.

4. The transformer of claim 1, wherein the magnetic circuits are made of nanocrystalline iron.

5. The transformer of claim 2, wherein each voltage rectifier circuit comprises, at its terminals, a filtering capacitor, each voltage rectifier circuit configured to generate a continuous voltage at the outlet of the transformer.

6. A power supply for an X-ray tube comprising the high-voltage transformer of claim 2.

7. A medical imaging device comprising the X-ray tube power supply of claim 6.

* * * * *